US005450734A

United States Patent [19]

Esaki et al.

[11] Patent Number: 5,450,734

[45] Date of Patent: Sep. 19, 1995

[54] DOOR LOCKING HANDLE ASSEMBLY OF PULL-OUT AND SIDE-SWINGING LEVER-ACTION TYPE

[75] Inventors: Takanobu Esaki; Kenichi Yamada, both of Tokyo, Japan

[73] Assignee: Takigen Manufacturing Co., Ltd., Tokyo, Japan

[21] Appl. No.: 197,063

[22] Filed: Feb. 16, 1994

[30] Foreign Application Priority Data

Mar. 9, 1993 [JP] Japan ..... 5-075294

[51] Int. Cl.[6] ..... E05B 13/10

[52] U.S. Cl. ..... 70/208; 70/210; 70/215; 70/224; 292/202; 292/DIG. 31

[58] Field of Search ..... 70/208, 210, 215, 224, 70/467, 469, 489, 201, 205, 192–197, 462, 466, DIG. 31, DIG. 33; 292/202, DIG. 31, DIG. 72, 244, 336.3

[56] References Cited

U.S. PATENT DOCUMENTS

| | | | |
|---|---|---|---|
| 4,510,779 | 4/1985 | Ahad | 70/481 X |
| 4,693,503 | 9/1987 | Bisbing | 292/DIG. 60 X |
| 5,201,557 | 4/1993 | Schlack | 292/161 |
| 5,267,762 | 12/1993 | Gromotka | 292/229 |
| 5,321,962 | 6/1994 | Ferchau et al. | 70/225 X |
| 5,347,834 | 9/1994 | Ramsauer | 70/DIG. 63 X |

FOREIGN PATENT DOCUMENTS

| | | |
|---|---|---|
| 198764 | 12/1988 | Japan . |
| 66369 | 6/1991 | Japan . |

*Primary Examiner*—Lloyd A. Gall
*Attorney, Agent, or Firm*—Martin Smolowitz

[57] ABSTRACT

A door locking handle assembly of a pull-out and side-swinging lever-action type includes a casing (1) having a locking shaft (11) and a handle (18) which can be swung out and pushed in a front concave portion (3) of the casing smoothly without fail. A push button (24) is pivoted to a front end of the handle (18) through a cross pivot (31), and has its intermediate portion (26) partially formed into a corrugated surface (28). A corrugated leaf spring (32) is fixed to a rear surface of the front end of the handle (18), so as to have its peak portion (**32*a*) engage with a trough portion (28*b*) of the corrugated surface (28) of the push button (24) so that the push button (24) is held in a depressed position, whereby an engaging hook portion (29) of the push button (24) is held in its retracted position free from a receiving portion (5) of the casing (1**).

5 Claims, 5 Drawing Sheets

DOOR LOCKING HANDLE ASSEMBLY OF PULL-OUT AND SIDE-SWINGING LEVER-ACTION TYPE

BACKGROUND OF THE INVENTION

1. Field of the Invention

The present invention relates to a door locking handle assembly of a pull-out and side-swinging lever-action type. The door locking handle assembly is used in a plugboard box and the like. In operation, the retractable handle of the assembly is pulled out of its casing and side-swung through a predetermined angle to permit a catch plate of the assembly to be free from a receiving portion of a stationary frame element.

2. Description of the Prior Art

In a conventional door locking handle assembly of a pull-out and side swinging lever-action type disclosed in Japanese Utility Model Laid-Open No. Hei 3-66369: a cylinder portion is provided in a base-end portion of a casing fixedly mounted on a door; a locking shaft is inserted in the cylindrical portion and rotatably mounted therein but not axially slidable therein; a catch plate is fixedly mounted on a rear-end portion of the looking shaft; a retractable handle folds into a front concave portion of the casing, and has its base-end portion pivoted to a front-end portion of the locking shaft through a first cross pivot; a biasing spring for swingably biasing the retractable handle in its projecting direction on the first cross pivot, the biasing spring being mounted between the locking shaft and the handle; a push button has its leg portion projected from its rear surface, and is provided with a locking hole and an engaging-hook portion in a front-end portion of the leg portion, the push button being connected with a front-end portion of the handle through a second cross pivot; a position-keeping spring disposed between the handle and the push button, and forces the push button to align with the handle along an extension line thereof; a lock unit is fixedly embedded in a lock-receiving portion provided in a front-end portion of the casing; and, a latch element is so arranged as to be interlocked with a rotor of the lock unit, and is biased forward towards the leg portion of the push button by a return spring to have a front-end portion of the latch element engaged with the locking hole so that the handle is locked up in its retracted position.

However, in the conventional door locking handle assembly described above, since the push button is not held in its depressed position when the handle is projected by depressing the push button, there is a fear that the handle is locked up again in its retracted position. Further, when the handle is retracted in the front concave portion of the casing, there is a fear that the push button having been pivoted to the front-end portion of the handle through the cross pivot is over-swung in a direction opposite to the latch element. As a result, when the handle is released from its retracting operation before it is completely retracted in the casing, the locking hole of the front end of the push button fails to engage with the corresponding front-end portion of the latch element so that the handle is swung on the first cross pivot in its projecting; direction under the influence of the biasing spring, which makes it impossible to retract the handle in the casing.

SUMMARY OF THE INVENTION

It is an object of the present invention to provide a door locking flush handle assembly of a pull-out and side-swinging lever-action type, in which a handle is smoothly pushed into and swung out of a front concave portion of a casing without fail.

The above objects of the present invention are accomplished by providing:

- a door locking handle assembly of a pull-out and side-swinging lever action type, comprising:
- a casing for fixedly mounting on a door;
- a locking shaft rotatably mounted in a cylindrical portion of a base-end portion of the casing in an insertion manner, said locking shaft being non-axially slidable in the cylindrical portion and having its rear-end portion fixed to a catch plate;
- a retractable handle which folds into a front concave portion of the casing, and has its base-end portion pivoted to a front-end portion of the locking shaft through a first cross pivot;
- a biasing spring for swingably biasing the handle in its projecting direction on the first cross pivot, the biasing spring being mounted between the locking shaft and the handle;
- a push button which is connected with a front-end portion of the handle through a second cross pivot and is provided with a leg portion projecting from its rear surface, the leg portion having its front-end portion formed into an engaging-hook portion and further having its intermediate portion formed into a projecting portion which is provided with an axial hole and has its base-end portion partially formed into a corrugated surface, the axial hole receiving the second cross pivot therein;
- a corrugated leaf spring fixedly mounted in a rear side of the front-end portion of the handle; and
- a lock unit which is fixedly embedded in a lock-receiving portion of the front-end portion of the handle, and comprises a rotor which is rotated by a key to move a lock plate forward and backward so that the lock plate abuts against the leg portion of the push button to prevent the push button from rotating;
- wherein a receiving portion is provided in a bottom portion of a projecting portion formed in the front-end portion of a front concave portion of the casing, and engages with the engaging-hook portion of the push button to hold the handle in its retracted position, and wherein the corrugated surface of the push button engages with the leaf spring to have the push button aligned with the handle along its extension line when the handle is in its retracted position and to have the push button held in its depressed position when the push button is depressed.

DESCRIPTION OF THE PREFERRED EMBODIMENTS

Figure 1:
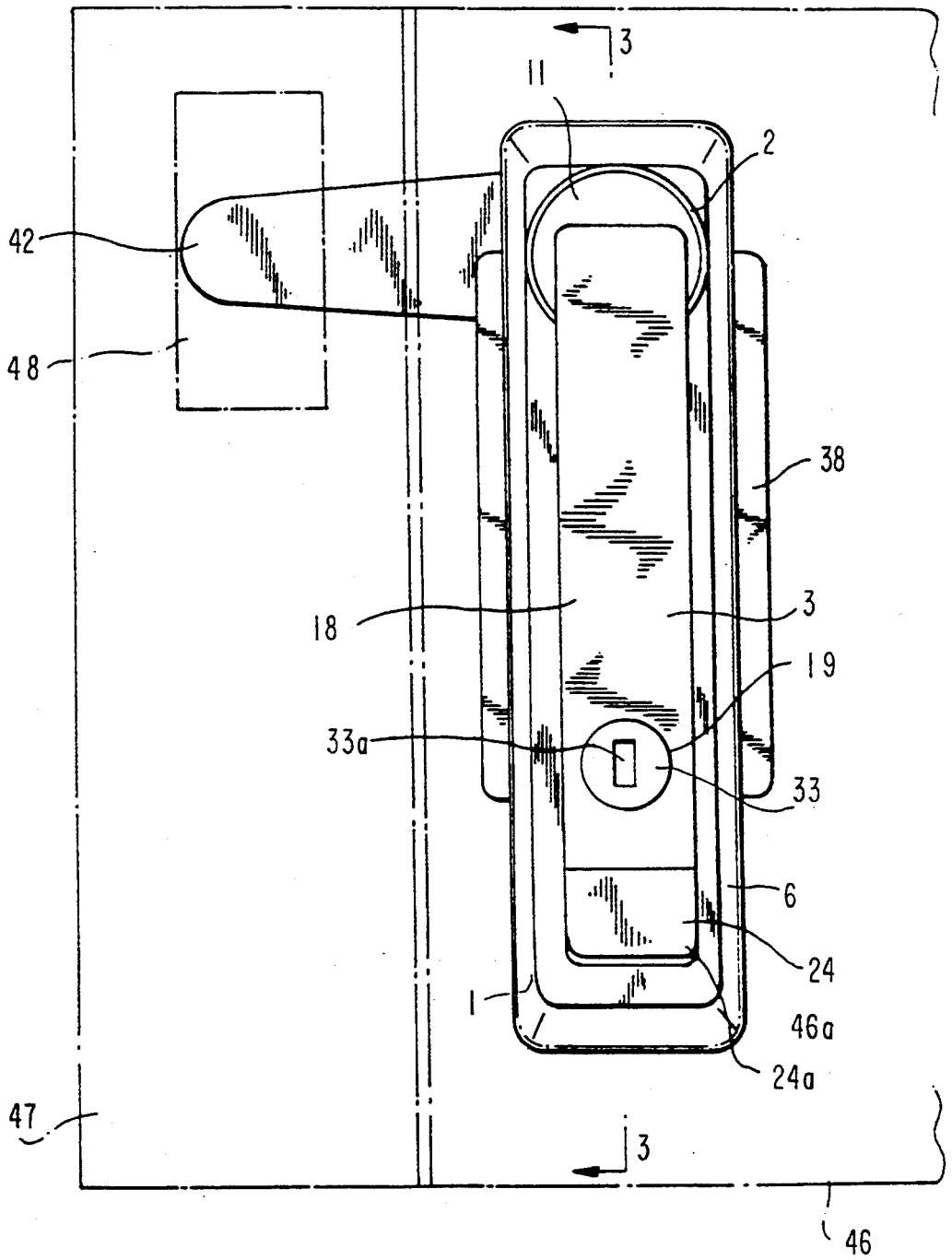
FIG. 1 is a front view of an embodiment of the door locking handle assembly of a pull-out and side-swinging lever-action type of the present invention in a condition in which the handle is retracted.
Figure 2:
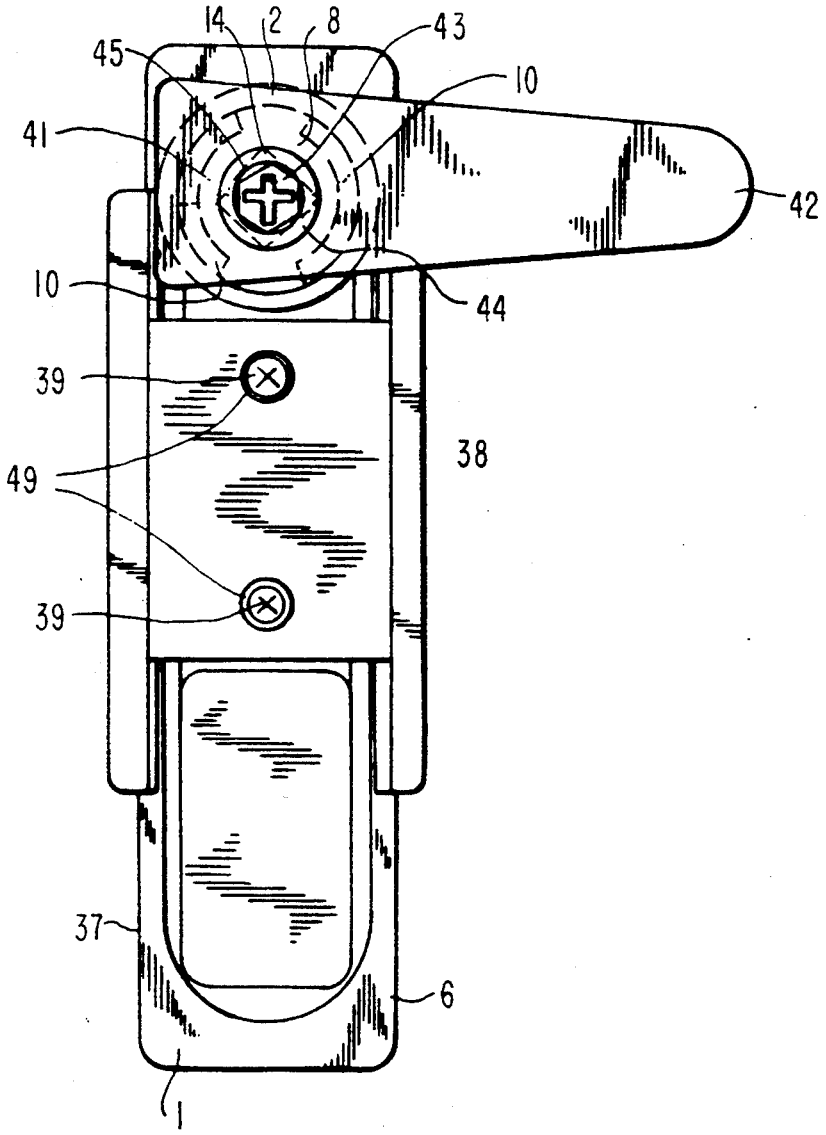
FIG. 2 is a rear view of the door locking assembly of the present invention shown in FIG. 1.

Hereinbelow, the present invention will be described in detail with reference to the accompanying drawings and the reference numerals and characters.

In a door locking handle assembly of a pull-out and side-swinging type according to the present invention, as shown in FIG. 1, a casing 1 is fixedly mounted on a door 46, and provided with a cylindrical portion 2 in its base-end portion. Rotatably mounted in the cylindrical portion 2 is a locking shaft 11 to a rear-end portion of which a catch plate 42 is fixedly mounted.

A retractable handle 18 folds into a front concave portion 3 of the casing 1 so as to be projectable therefrom. The handle 18 has its base-end portion pivoted to a front-end portion of the locking shaft 11 through a first cross pivot 17. A biasing spring 23 is disposed between the locking shaft 11 and the handle 18, and forces the handle 18 to swing on the cross pivot 17 in a projecting direction of the handle 18.

A push button 24 is connected with a front-end portion of the handle 18 through a second cross pivot 31 passing through an axial hole 27 formed in a projecting portion 26 which is provided in an intermediate portion of a leg portion 25 of the push button 24. The leg portion 25 projects from a rear surface of the push button 24, and has its front-end portion formed into an engaging hook portion 29. The projecting portion 26 of the push button 24 has its base-end portion partially formed into a corrugated surface 28.

A corrugated leaf spring 32 is fixedly mounted in a rear side of a front-end portion of the handle 18, and is engaged with the corrugated surface 28 of the push button 24. When the handle 18 is in its retracted position, the leaf spring 32 has the push button 24 aligned with the handle 18 along an extension line of the handle 18. On the other hand, when the push button 24 is depressed, the leaf spring 32 holds the push button 24 in a depressed position thereof.

A lock unit 33 is fixedly embedded in a lock-receiving portion 19 of the front-end portion of the handle 18, and comprises a rotor 34 which is rotated by a key 35 to move a lock plate 36 forward and backward, so that the lock plate 36 abuts against the leg portion 25 of the push button 24 to prevent the push button 24 from rotating (i.e., swinging on the second cross pivot 31).

In the assembly of the present invention having the above construction: a receiving portion 5 is provided in a bottom portion of the projecting portion 4 formed in a front-end portion of the front concave portion 3 of the casing 1, and engages with the engaging-hook portion 29 of the push button 24 to hold the handle 18 in its retracted position.

Figure 3:
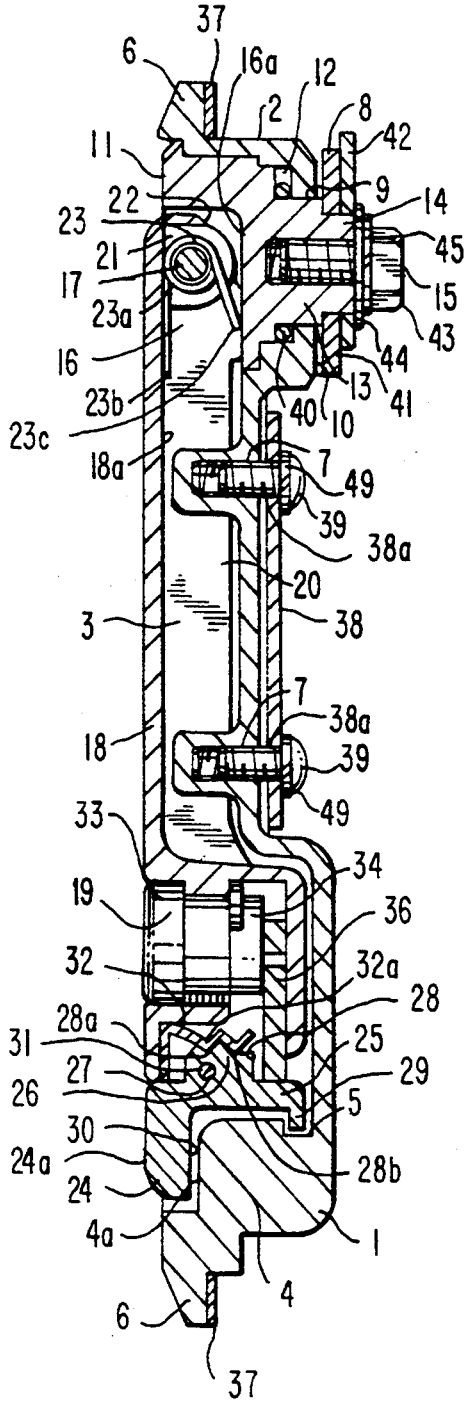
FIG. 3 is a longitudinal sectional view of the door locking assembly of the present invention, taken along the line 3—3 of FIG. 1.

As shown in FIG. 3, in case that the handle 18 is held in its retracted position within the front concave portion 3 of the casing 1, a trough portion 28*a* of the corrugated surface 28 of the push button 24 engages with a peak portion 32*a* of the leaf spring 32, so that the push button 24 is forced to align with the handle 18 along its extension line under the influence of a resilient force exerted by the leaf spring 32. At this time, the engaging-hook portion 29 of the push button 24 engages with a receiving portion 5 of the casing 1, and the lock plate 36 is in its projecting position in which the lock plate 36 is brought into a close contact with a rear surface of the leg portion 25 of the push button 24, which prevents the push button 24 from rotating and enables the handle 18 to be locked up in its retracted position without fail.

Figure 4:
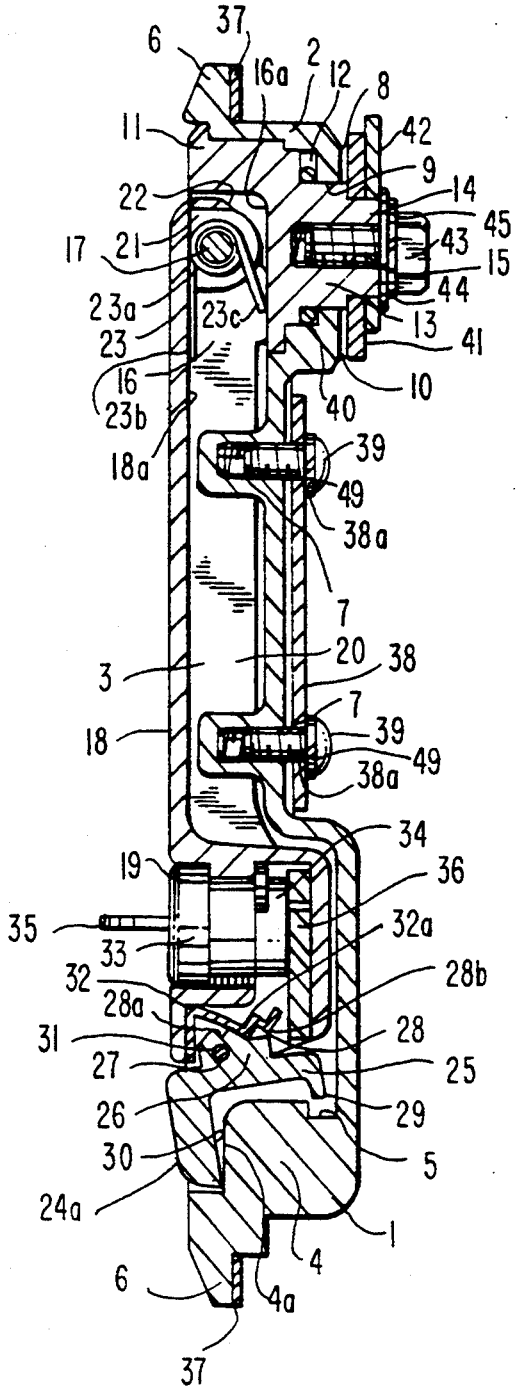
FIG. 4 is a longitudinal sectional view of the door locking assembly of the present invention shown in FIG. 1 in a condition in which the push button is depressed and the handle is retracted in the casing; and, FIG. 5 is a longitudinal sectional view of the door locking assembly of the present invention shown in FIG. 1 in a condition in which the handle is projected from the casing.

As shown in FIG. 4, in order to project the handle 18, the key 35 is inserted in a keyhole 33*a* of the lock unit 33 to rotate the rotor 34 in its unlocking direction, so that the lock plate 35 is moved backward to release the push button 24 from the restriction on its rotating motion. Under such circumstances, when a front-surface portion 24*a* of the push button 24 is depressed by the user's finger, the push button 24 swings on the second cross pivot 31 toward the lock unit 33 against a resilient force exerted by the leaf spring 32, so that the engaging-hook portion 29 of the leg portion 25 is disengaged from the receiving portion 5. At this stage, an engaging position of the corrugated surface 28 of the push button 24 with the leaf spring 32 moves so that the trough portion 28*b* of the corrugated surface 28 engages with the peak portion 32*a* of the leaf spring 32. The push button 24 remains in its depressed position in which the engaging-hook portion 29 is held in its retracted position to be free from the receiving portion 5 of the casing 1.

Figure 5:
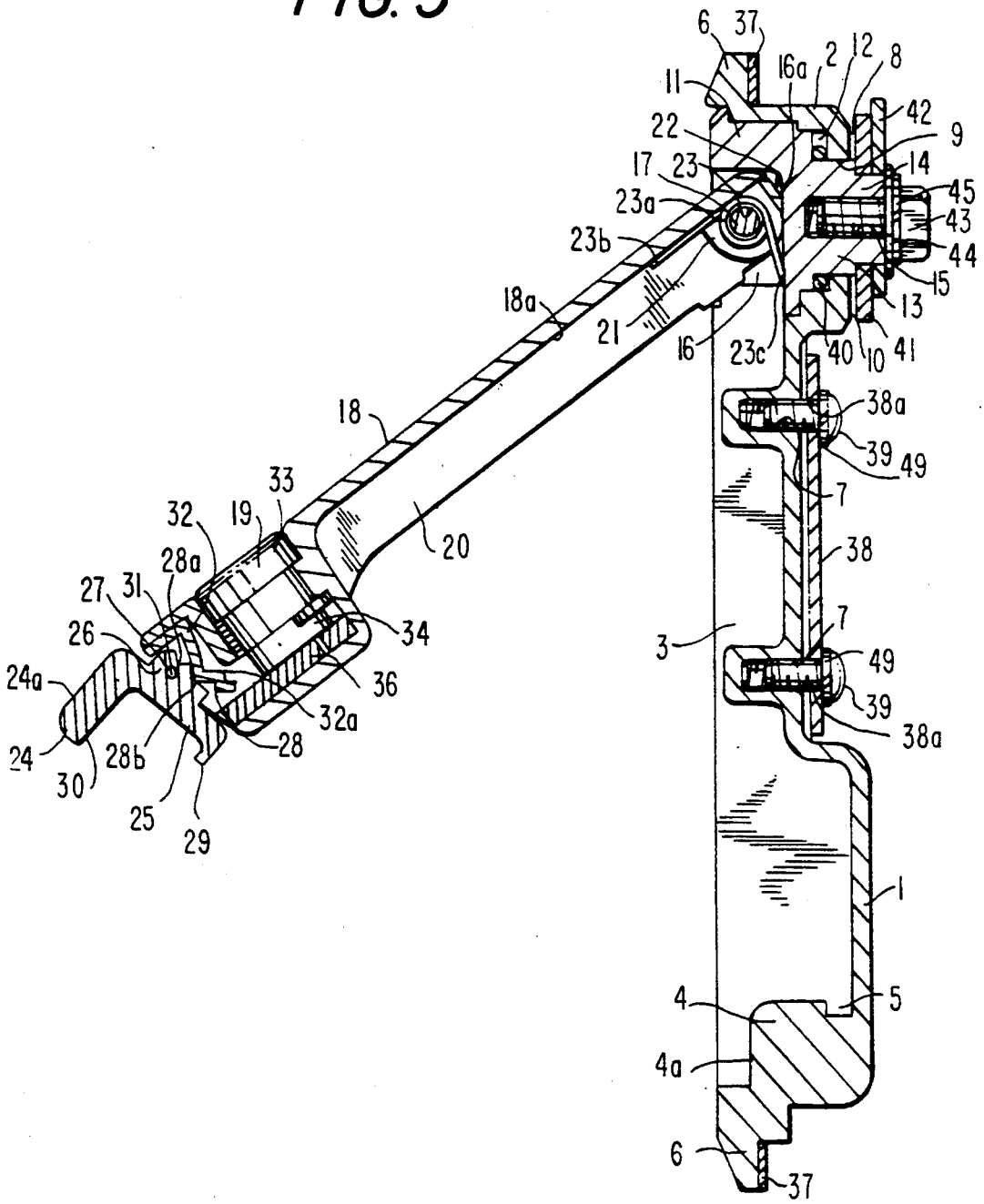

When the front-surface portion 24*a* of the push button 24 is released from the user's finger depressing the push button 24, the handle 18 is immediately swung on the first cross pivot 17 under the influence of the resilient force exerted by the biasing spring 23, so that the handle 18 is projected from the front concave portion 3 of the casing 1, as shown in FIG. 5. Even when the handle 18 is projected, the trough portion 28*b* of the corrugated surface 28 of the push button 24 still engages with the peak portion 32*a* of the leaf spring 32 so that the push button 24 is still held in its depressed position.

When the thus projected handle 18 is side-swung in a predetermined direction, the locking shaft 11 (which is connected with the handle 18 through the first cross pivot 17 and rotatably supported by the cylindrical portion 2 of the casing 1) is rotated together with the handle 18 so that the catch plate 42 is disengaged from the receiving portion 48 of the stationary frame element 47. As a result, it is possible to open the door 46 (which is unlocked from the stationary frame element 47) by pulling the handle 18 forward. In such door opening operation, the lock-receiving portion 19 provided in the front-end portion of the handle 18 and the leg portion 25 of the push button 24 (which is connected with the front-end portion of the handle 18) serve as appropriate finger-engaging portions.

After the door 46 is closed, the handle 18 is reversely swung to have the catch plate 42 engaged again with the receiving portion 48 of the stationary frame element 47, and then the handle 18 is pushed into the front concave portion 3 of the casing 1. In this case, as shown in FIG. 4, a front-end portion 30 of the rear surface side of the push button 24 abuts against an tipper surface 4*a* of the projecting portion 4 of the casing 1. The push button 24 is swung against the resilient force exerted by the leaf spring 32 so that the engaging position of the corrugated surface 28 with the leaf spring 32 moves, whereby the trough portion 28*a* of the corrugated surface 28 engages with the peak portion 32*a* of the leaf spring 32, and the engaging-hook portion 29 engages with the receiving portion 5. As a result, the handle 18 is held in its retracted position without fail. Under such circumstances, when the rotor 34 is rotated in the locking direction so as to have the lock plate 36 move to its projecting position in which the lock plate 36 abuts against the rear surface of the leg portion 25 of the push button 24, the push button 24 is prevented from rotating. As a result, as shown in FIG. 3, the handle 18 is locked up in its retracted position in the front concave portion 3 of the casing 1 without fail. Finally, the key 35 is pulled out of the keyhole 33*a* of the lock unit 33 so that a series of unlocking and locking operations are completed.

In the embodiment of the present invention shown in the drawings, as shown in FIG. 1, the elongated casing 1 is inserted into an elongated opening 46*a* of the door 46 from its front surface side to have its outer peripheral flange portion 6 abut on the front surface of the door 46. A watertight packing 37 is fitted in a clearance between the outer peripheral flange portion 6 and the front surface of the door 46. Then, a mounting plate 38, which is disposed in an intermediate portion of the casing 1 to cover the same portion, is abutted against a rear surface of the door 46, and fixedly mounted on the door 46 through screws 39 each of which passes through a through-hole 38*a* of the mounting plate 38 and is threadably connected with a blind hole 7 of a rear surface wall of the intermediate portion of the casing 1.

A watertight O-ring 40 is fitted in an annular groove 12 of the intermediate portion of the locking shaft 11 which has its small-diameter portion 13 fitted in an axial hole 9 of a rear-surface wall portion 8 of the cylindrical portion 2 of the casing 1. The small-diameter portion 13 of the locking shaft 11 is followed by a square-column portion 14 on which both a swing-angle limiting plate 41 and the catch plate 42 are mounted in an insertion manner, and then a bolt 43 is threadably connected with a threaded hole 15 of the square-column portion 14 to have these plates 41, 42 fixed to the square-column portion 14, so that the locking shaft 11 is rotatably mounted in the cylindrical portion 2 of the casing 1 but not axially slidable therein. The rear-surface wall portion 8 of the cylindrical portion 2 of the casing 1 is provided with a swing-angle limiting projection 10 which abuts against the swing-angle limiting plate 41 to limit the swing angle of the catch plate 42.

A pair of ribs 20 are provided in opposite side surfaces of the handle 18. Inside the opposite side ribs 20 in the base-end portion of the handle 18, there is provided a cylindrical portion 21 assuming a semispherical shape in its side view. Inserted in an elongated recess 16 provided in a front-end portion of the locking shaft 11 is the base-end portion of the handle 18, so that the cylindrical portion 21 of the handle 18 is guided by the recess 16 of the locking shaft 11, whereby the handle 18 swings on the first cross pivot 17 relative to the locking shaft 11. At this time, the handle 18 is obliquely projected forward while supported by the recess 16, and is side-swung together with the locking shaft 11.

A side-surface portion 16*a* of an inner surface of the recess 16 abuts on an oblique surface 22 provided in the base-end portion of the handle 18 to determine a projecting angle of the handle 18 relative to the casing 1. The biasing spring 23 is constructed of a coil spring which has: its coiled portion 23*a* mounted on the first cross pivot 17 in an insertion manner; one 23*c* of its opposite linear portions 23*b*, 23*c* abutted against the bottom-surface portion 16*a* of the recess 16 of the locking shaft 11; and, the remaining one 23*b* of its opposite linear portions 23*b*, 23*c* abutted against the rear-surface portion 18*a* of the handle 18.

In the embodiment of the present invention described above, the corrugated leaf spring 32 is fixed to the rear surface of the front-end portion of the handle 18 by staking. However, it is also possible to fix the leaf spring by means of screws.

In the embodiment of the present invention, a rotary type mechanism for locking the rotor 34 of the lock unit 33 to the main body of the lock unit is provided. However, it is also possible to use any other suitable lock mechanisms such as radial-pin tumbler locking mechanisms, axial-pin tumbler mechanisms and the like.

As described above, in the door locking handle assembly of the pull-out and side-swinging lever-action type of the present invention: when the push button 24 (which is pivoted to the front end of the handle 18) is depressed, the trough portion 28*b* of the corrugated surface 28 of the push button 24 engages with the peak portion 32*a* of the leaf spring 32 to hold the push button 24 in its depressed position; and, at this time, since the engaging-hook portion 29 of the push button 24 is held in its retracted position free from the receiving portion 5 of the casing 1, there is no fear that the handle 18 is locked up again, which makes it possible to have the handle 18 smoothly projected.

Further, when the handle 18 is retracted in the casing 1, the front-end portion 30 of the rear surface of the push button 24 having been held in its depressed position abuts against the upper surface 4*a* of the projecting portion 4 of the casing 1, so that the push button 24 is rotated or swung against the resilient force exerted by the leaf spring 32, whereby the engaging position of the corrugated surface 28 with the leaf spring 32 moves to have: the trough portion 28*a* of the corrugated surface 28 engage with the peak portion 32*a* of the leaf spring 32; and, the engaging-hook portion 29 engage with the receiving portion 5 of the casing 1. Consequently, it is possible to hold the handle 18 in its retracted position smoothly without fail.

Further, in a condition in which the handle 18 is in its retracted position: the trough portion 28*a* of the corrugated surface 28 engages with the peak portion 32*a* of the leaf spring 32; and, the push button 24 is swung on the second cross pivot 31 so that the push button 24 is aligned with the handle 18 along the extension line of the handle 18. In this case, the leaf spring 32 further serves as a position-keeping spring, which contributes to reduction of the number of the assembly's parts and the manufacturing cost thereof.

Further, in the present invention, when the user's finger moves away from the front-surface portion 24*a* of the push button 24 to release the push button 24 from a pressure applied by the user's finger, the handle 18 immediately swings on the first cross pivot 17 outward under the influence of the resilient force exerted by the biasing spring 23 so that the handle 18 projects out of the front concave portion 3 of the casing 1. At this time, since the user's finger has already moved away from the front-surface portion 24*a* of the push button 24, there is no fear that the user's finger is hit by the leg portion 25 of the push button 24 and by the front-end portion of the handle 18. Further, since the leg portion 25 of the push button 24 may effectively serve as a finger-engaging portion, it is possible to reduce in length the handle 18 by an amount corresponding to that of the push button 24. As a result, according to the present invention, it is possible to minimize the entire length of the casing 1 while keeping a sufficient length of the grip-portion of the handle 18.

Further, in the present invention, when the push button 24 is depressed, it is possible to have the push button 24 clear the projecting portion 32*a* of the leaf spring 36 smoothly with a less depressing effort than that required in the conventional assembly, which makes it possible to easily depress the push button 24 in use. Also, the engaging hook portion 29 of the push button 24 clears the projecting portion 4 of the casing 1 when the handle 18 is projected outwardly by action of the biasing spring 23.

What is claimed is:

1. A door locking handle assembly of a pull-out and side-swinging lever-action type, comprising:

a casing (1) for fixedly mounting on a door (46);

a locking shaft (11) rotatably mounted in a cylindrical portion (2) of a base-end portion of said casing (1) in an insertion manner, said locking shaft (11) being non-axially slidable in said cylindrical portion (2) and having its rear-end portion fixed to a catch plate (42);

a retractable handle (18) which folds into a front concave portion (3) of said casing (1), and has its base-end portion pivoted to a front-end portion of said locking shaft (11) through a first cross pivot (17);

a biasing spring (23) for swingably biasing said handle (18) in its projecting direction on said first cross pivot (17), said biasing spring (23) being mounted between said locking shaft (11) and said handle (18);

a push button (24) which is connected with a front-end portion of said handle (18) through a second cross pivot (31) and is provided with a leg portion (25) projecting from its rear surface, said leg portion (25) having its front-end portion formed into an engaging-hook portion (29) and further having its intermediate portion formed into a projecting portion (26) which is provided with an axial hole (27) and has its base-end portion partially formed into a corrugated surface (28), said axial hole (27) receiving said second cross pivot (31) therein;

a corrugated leaf spring (32) fixedly mounted in a rear side of said front-end portion of said handle (18); and a lock unit (33) which is fixedly embedded in a lock-receiving portion (19) of said front-end portion of said handle (18), and comprises a rotor (34) which is rotated by a key (35) to move a lock plate (36) forward and backward, so that said lock plate (36) abuts against said leg portion (25) of said push button (24) to prevent said push button (24) from rotating;

wherein a receiving portion (5) is provided in a bottom portion of a projecting portion (4) formed in said front concave portion (3) of said casing (1), and engages with said engaging-hook portion (29) of said push button (24) to hold said handle (18) in its retracted position, and wherein said corrugated surface (28) of said push button (24) engages with said leaf spring (32) to have said push button (24) aligned with said handle (18) along its extension line when said handle (18) is in its retracted position and to have said push button (24) held in its depressed position when said push button (24) is depressed.

2. The door locking handle assembly of claim 1, wherein a sealing ring (40) is provided in an annular groove (12) around a smaller diameter portion (13) of said locking shaft (11).

3. The door locking handle assembly of claim 1, wherein said retractable handle (18) has an oblique surface (22) provided at the handle base-end portion, which surface abuts on a recess surface (16*a*) for determining the projecting angle of the handle relative to the casing (1).

4. The door locking handle assembly of claim 1, wherein said casing (1) is inserted into an elongated opening of a door (46) so that a peripheral flange portion (6) abuts against the door front side and a mounting plate (38) attached to the casing is abutted against the door rear side and is fixedly mounted on the casing (1).

5. The door locking handle assembly of claim 1, wherein said catch plate (42) is engaged against a receiving portion (48) of a stationary frame element.

* * * * *